US009359905B2

(12) United States Patent
Lamicq et al.

(10) Patent No.: US 9,359,905 B2
(45) Date of Patent: Jun. 7, 2016

(54) TURBINE ENGINE ROTOR BLADE GROOVE

(75) Inventors: Olivier Jacques Louis Lamicq, Poway, CA (US); Fernando Manuel Ibarra Esparragoza, San Diego, CA (US); Paul Francis Norton, San Diego, CA (US); Jeremiah Wesley Key, San Marcos, CA (US)

(73) Assignee: Solar Turbines Incorporated, San Diego, CA (US)

( * ) Notice: Subject to any disclaimer, the term of this patent is extended or adjusted under 35 U.S.C. 154(b) by 590 days.

(21) Appl. No.: 13/405,738

(22) Filed: Feb. 27, 2012

(65) Prior Publication Data

US 2013/0224036 A1 Aug. 29, 2013

(51) Int. Cl.
*F01D 5/30* (2006.01)

(52) U.S. Cl.
CPC ..... *F01D 5/3007* (2013.01); *F05D 2250/29* (2013.01); *F05D 2250/712* (2013.01)

(58) Field of Classification Search
CPC ..... F01D 5/3007; F01D 5/30; F05D 2250/29; F05D 2250/712
USPC ..... 416/239, 248
See application file for complete search history.

(56) References Cited

U.S. PATENT DOCUMENTS

| | | | | |
|---|---|---|---|---|
| 2,315,631 | A | 4/1943 | Lloyd et al. | |
| 4,191,509 | A | 3/1980 | Leonardi | |
| 5,110,262 | A | 5/1992 | Evans | |
| 5,141,401 | A | 8/1992 | Juenger et al. | |
| 5,160,242 | A | 11/1992 | Brown | |
| 5,435,694 | A * | 7/1995 | Kray et al. | 416/219 R |
| 5,554,005 | A | 9/1996 | Nguyen | |
| 6,033,185 | A | 3/2000 | Lammas et al. | |
| 6,106,188 | A | 8/2000 | Krautzig et al. | |
| 6,146,099 | A * | 11/2000 | Zipps et al. | 416/193 A |
| 6,390,775 | B1 * | 5/2002 | Paz | 416/193 A |
| 6,951,447 | B2 | 10/2005 | Cherolis et al. | |
| 7,165,944 | B2 | 1/2007 | Gautreau et al. | |
| 7,594,799 | B2 * | 9/2009 | Miller et al. | 416/219 R |

(Continued)

FOREIGN PATENT DOCUMENTS

| | | |
|---|---|---|
| CN | 101769171 | 7/2010 |
| EP | 431766 | 11/1990 |

(Continued)

OTHER PUBLICATIONS

S.J. Shaffer et al., "Fretting Fatigue," ASM Handbook, pp. 321-330, vol. 19 (1996) (.

*Primary Examiner* — Christopher Verdier
*Assistant Examiner* — Juan G Flores
(74) *Attorney, Agent, or Firm* — Finnegan, Henderson, Farabow, Garrett & Dunner, LLP

(57) ABSTRACT

A rotor blade for a gas turbine engine has an airfoil, a base integrally joined to the airfoil, and a root integrally joined to the base and mountable in a slot in a rotor hub of the gas turbine engine. The root has a dovetail including at least one contact face that, when mounted, contacts a surface of the slot to retain the rotor blade in the hub. The root includes a neck between the base and the dovetail, and a groove in the neck for redirecting stress in the rotor blade. In certain embodiments, the groove is at a distance from the at least one contact face, has a length less than a length of the dovetail, and/or has an initial non-zero depth at the side of a trailing edge of the airfoil and tapers to a zero depth in the direction of the leading edge of the airfoil.

10 Claims, 5 Drawing Sheets

(56) References Cited

U.S. PATENT DOCUMENTS

| | | | |
|---|---|---|---|
| 2008/0063529 | A1 | 3/2008 | Miller et al. |
| 2008/0159866 | A1 | 7/2008 | Evans |
| 2009/0087316 | A1 | 4/2009 | Mueller |
| 2009/0297351 | A1 | 12/2009 | Brahmasuraih |
| 2011/0027091 | A1 | 2/2011 | Clemen |

FOREIGN PATENT DOCUMENTS

| | | |
|---|---|---|
| EP | 1048821 | 11/2000 |
| GB | 29199 | 0/1912 |

* cited by examiner

TURBINE ENGINE ROTOR BLADE GROOVE

TECHNICAL FIELD

The present disclosure relates generally to turbine engines, and more particularly, to a turbine engine rotor blade having a groove for redirecting stress in the rotor blade.

BACKGROUND

Gas turbine engines include a multistage axial compressor that pressurizes air, mixes the pressurized air with fuel, and ignites the compressed air/fuel mixture to generate hot combustion gases that flow downstream through a high pressure turbine, which extracts useful energy therefrom. Each compressor stage usually includes a row of compressor rotor blades extending radially outwardly from a supporting rotor hub. Each blade includes an airfoil over which the air being pressurized flows.

The high speed with which the compressor hub rotates during operation generates very large centrifugal forces that stress the rotor blades. Over time, the stresses can damage the rotor blades, requiring them to be replaced. Accordingly, the rotor blades are usually designed to be removable so they can be replaced without replacing the hub or other parts of the turbine engine. For example, rotor blades typically have a root beneath with a dovetail configured to engage a complementary dovetail slot in the perimeter of the rotor hub. The dovetail has pressure faces that engage corresponding inner surfaces of the slot to retain the blade in the slot against the outward centrifugal force generated by the rotating hub. Typically, the dovetails are either axial-entry dovetails, which engage the slot in the direction of the axis of the turbine engine, or circumferential-entry dovetails, which engage the slot in the direction perpendicular to the axis of the turbine engine.

Techniques have been developed to prolong the useful life of the rotor hub and/or of the rotor blades themselves. One such technique is described in U.S. Pat. No. 6,033,185 to Lammas et al., issued on Mar. 7, 2000 (the '185 patent). According to the '185 patent, the maximum dovetail stress may be initially found at the dovetail neck in early blade life, but then transitions to the outer edges of the pressure faces at mid-life. The '185 patent states that this mid-life transition in maximum stress can lead to a shortening in remaining available life of the blade dovetails.

To purportedly address this problem, the '185 patent proposes a circumferentially-mounted rotor blade that includes undercuts in the pressure faces of the dovetail lobe. According to the '185 patent, the undercuts introduce a stress concentration in the neck of the rotor blade that initially increases the maximum stress experienced at outer edges of the pressure faces of the blade dovetail in early life (before the dry lubricant fails), but significantly reduces the maximum stress which would otherwise occur as the dry lubricant wears in operation beyond mid-life. The '185 patent explains that this tradeoff increases the overall life of the rotor blade. An undercut similar to the '185 patent undercut is also disclosed in S. J. Shaffer et al., *Fretting Fatigue*, ASM Handbook, Volume 19 (1996).

SUMMARY OF THE INVENTION

One aspect of the present disclosure relates to a rotor blade for a gas turbine engine. In one embodiment, the rotor blade may include an airfoil, a base integrally joined to the airfoil, and a root integrally joined to the base and mountable in a slot in a rotor hub of the gas turbine engine. The root may include a dovetail including at least one contact face that, when the root is mounted in the slot, contacts a surface of the slot to retain the rotor blade in the hub, and a neck between the base and the dovetail. In addition, the root may include a groove formed in the neck for redirecting stress in the rotor blade, wherein the groove is at a distance from the at least one contact face.

Another aspect of the disclosure relates to a rotor blade for a gas turbine engine. In one embodiment, the rotor blade may include an airfoil, a base integrally joined to the airfoil, and a root integrally joined to the base and mountable in a slot in a rotor hub of the gas turbine engine. The root may include a dovetail including at least one contact face that, when the root is mounted in the slot, contacts a surface of the slot to retain the rotor blade in the hub, a neck between the base and the dovetail, and a groove formed in the neck for redirecting stress in the rotor blade. A length of the groove may be less than a length of the dovetail, and the groove may be at a distance from the at least one contact face.

Yet another aspect of the disclosure relates to a rotor blade for a gas turbine engine. The rotor blade may include an airfoil including a leading edge and a trailing edge, a base integrally joined to the airfoil, and a root integrally joined to the base and mountable in a slot in a rotor hub of the gas turbine engine. The root may include a dovetail including at least one contact face that, when the root is mounted in the slot, contacts a surface of the slot to retain the rotor blade, and a neck between the base and the dovetail. The root may further include a groove formed in the neck for redirecting stress in the rotor blade. The groove may begin at the same side of the rotor blade as the trailing edge and extend toward the same side of the rotor blade as the leading edge. Additionally, the groove may have an initial non-zero depth at the side of the trailing edge and taper to a depth of zero in the direction of the leading edge.

DETAILED DESCRIPTION

Figure 1:
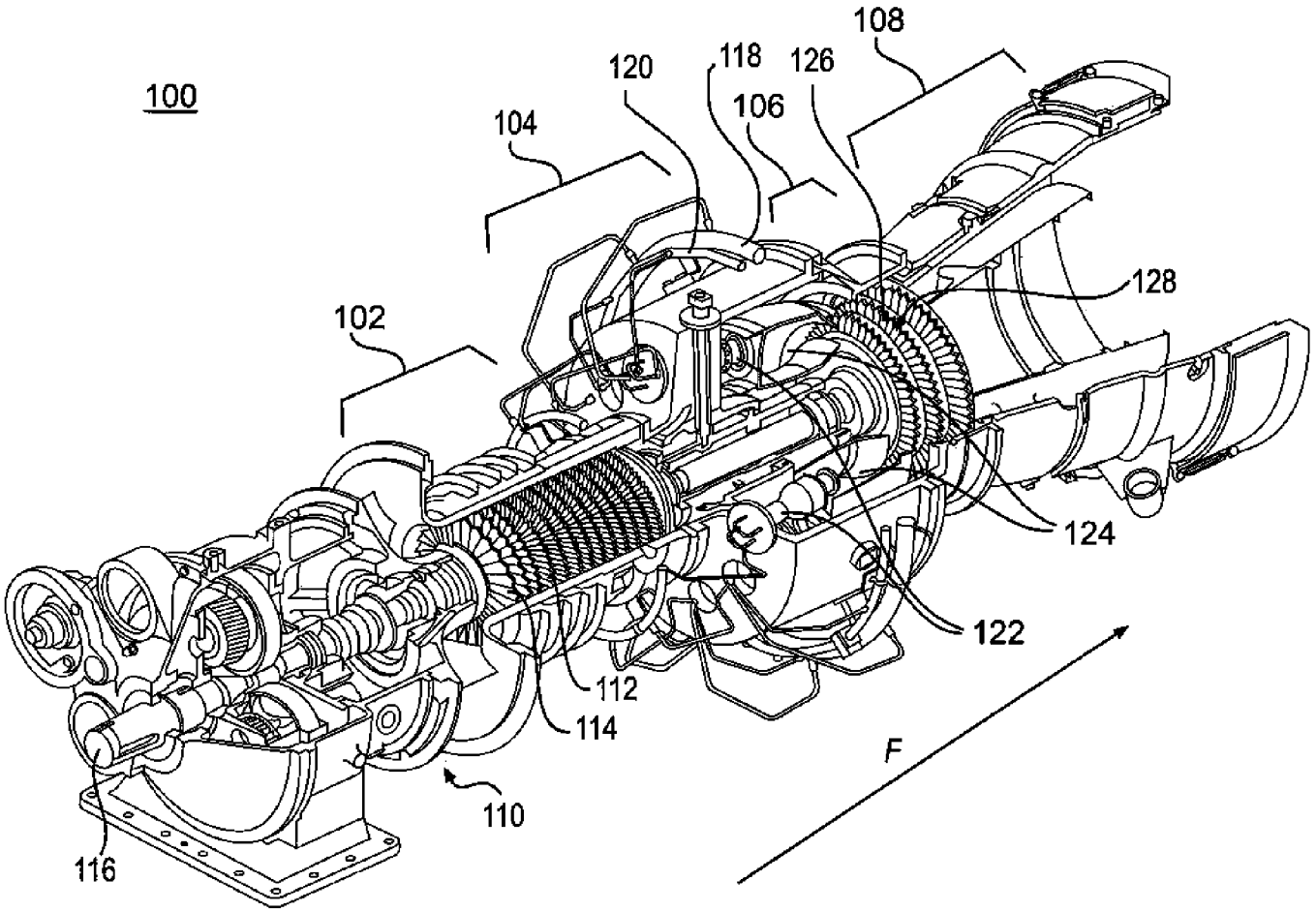
FIG. 1 is a representation of an exemplary gas turbine engine, consistent with the disclosed embodiments.

FIG. 1 illustrates an exemplary gas turbine engine 100, consistent with the disclosed embodiments. The turbine engine 100 may be associated with any type of stationary or mobile machine configured to accomplish a task. For example, the turbine engine 100 may be part of a generator set that generates electrical power for a power grid. In other embodiments, the turbine engine 100 may power a pump or other device. In still other embodiments, the turbine engine 100 may be the prime mover of an earth-moving machine, a locomotive, a marine vessel, an aircraft, or another type of mobile machine.

As shown, the turbine engine 100 may have, among other systems, a compressor system 102, a combustor system 104, a turbine system 106, and an exhaust system 108. In general, compressor system 102 collects air via an intake 110, and successively compresses the air in one or more consecutive compressor stages 112. As discussed below, each compressor stage 112 may include a rotor comprising a plurality of rotor blades 114 mounted to a hub, which is fixed to a rotational shaft 116 of the turbine engine 100. As the blades 114 rotate about the shaft 116, the intake air is compressed to a high pressure, and directed to the combustor system 104.

A gaseous fuel and/or a liquid fuel are directed to the combustor system 104 through a gaseous fuel pipe 118 and/or a liquid fuel pipe 120, respectively. The fuel is mixed with the compressed air in fuel injectors 122, and combusted in a combustor 124 of the combustor system 104.

Combustion of the fuel in the combustor 124 produces combustion gases having a high pressure, temperature, and velocity. These combustion gases are directed to the turbine system 106. In the turbine system 106, the high pressure combustion gases expand against turbine blades 126 to rotate turbine wheels 128, generating mechanical power that drives the rotational shaft 116. The spent combustion gases are then exhausted to the atmosphere through the exhaust system 108. Referring to FIG. 1, the compressed air may generally flow in a direction F parallel to the rotational shaft 116, which defines a lengthwise axis of the turbine engine 100.

Figure 2:
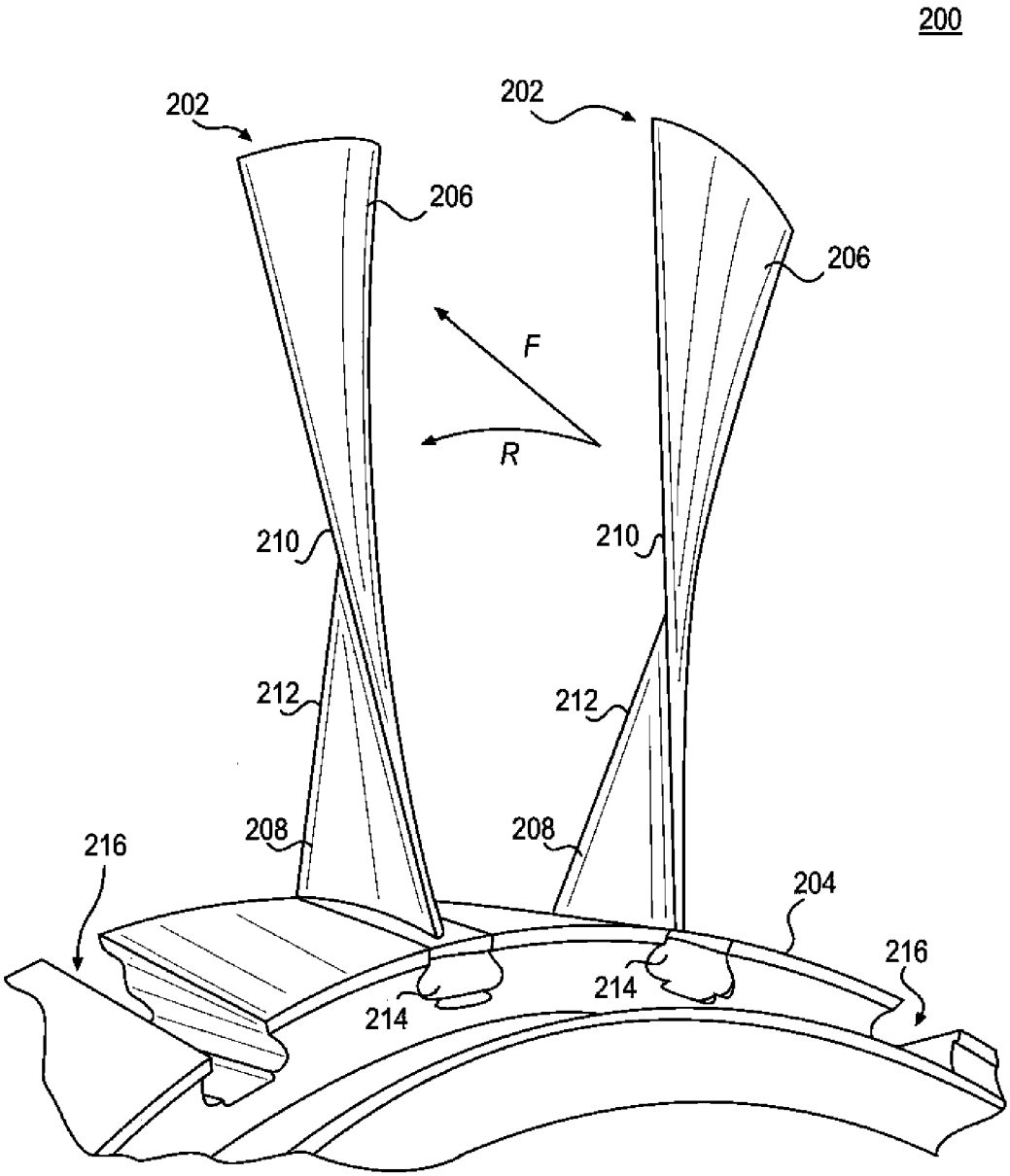
FIG. 2 is a representation of an exemplary rotor assembly of the turbine engine, consistent with the disclosed embodiments.

FIG. 2 shows a representation of a rotor assembly 200 associated with one or more of the compressor stages 112 (FIG. 1). As shown, the rotor assembly 200 may include a plurality of rotor blades 202 mountable in a rotational hub 204 that rotates about the rotational shaft 116 (FIG. 1). In operation, the hub 204 may rotate with the rotational shaft 116 in a direction R, causing the compressed air to flow in the direction F (i.e., parallel to the axis of the turbine engine 100) generally normal to the rotational plane R. Accordingly, each rotor blade 202 may have a suction sidewall 206 on a low pressure side of the rotor blade 202, as well as a pressure sidewall 208 on a high pressure side of the rotor blade 202. In addition, each rotor blade 202 may have a leading edge 210 located upstream with respect to the flow direction F and a trailing edge 212 located downstream with respect to the flow direction F.

FIG. 2 further shows that each rotor blade 202 may have a dovetail lobe 214 that slides into a corresponding slot 216 in the hub 204 in order to mount the rotor blade 202 to the hub 204. In one embodiment, shown in FIG. 2, slots 216 may be "axial" slots, meaning that the rotor blades 202 mount to the hub 204 by sliding their dovetail lobes 214 into the slots 216 in the general direction F of the flow.

Figure 3:
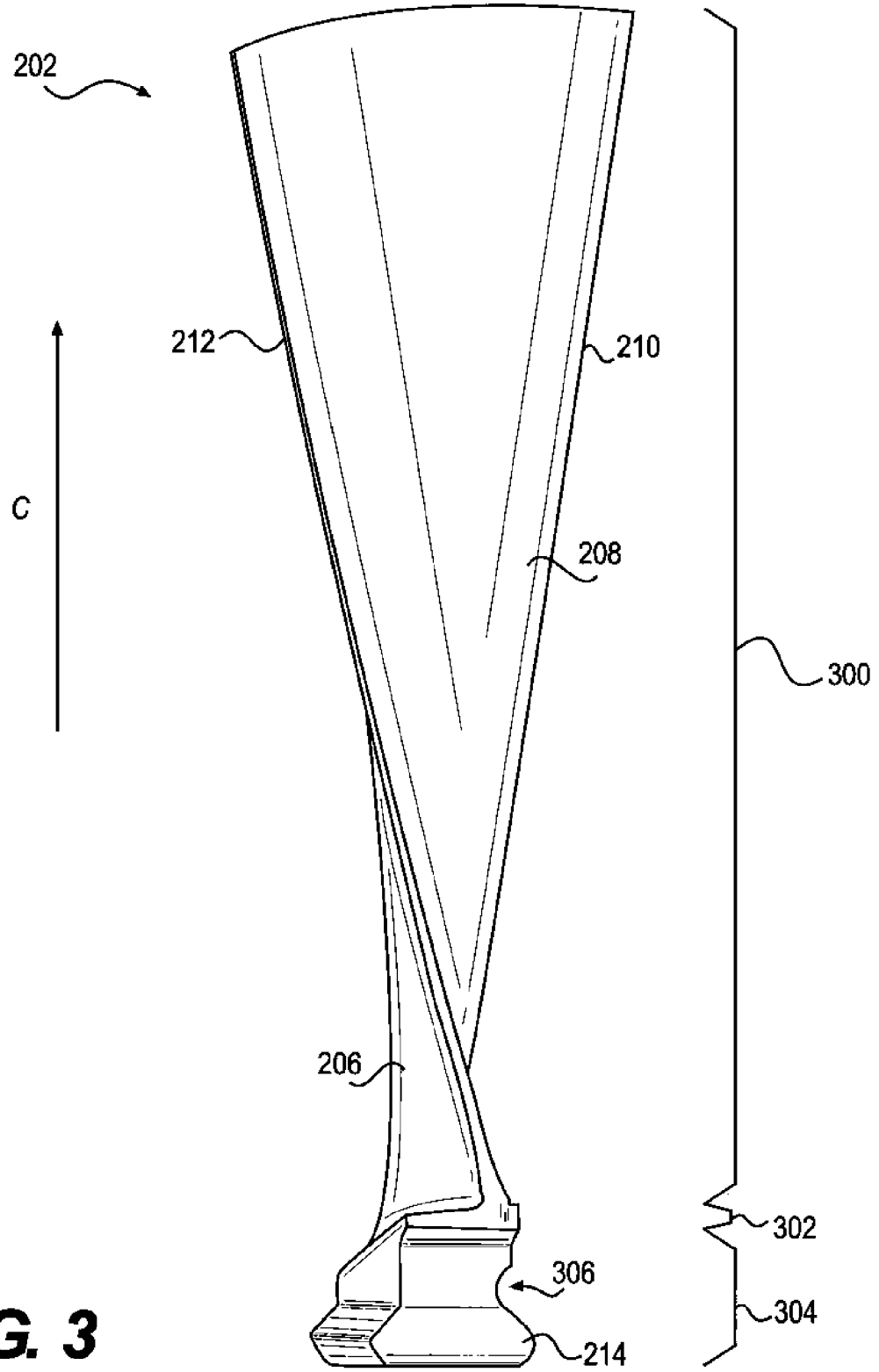
FIGS. 3-6 show representations of a rotor blade having a groove, consistent with the disclosed embodiments.

FIG. 3 illustrates a detailed view of the rotor blade 202. As shown in the figure, the rotor blade 202 may include an airfoil portion 300, a base portion (or platform) 302, and a root portion 304. The airfoil portion 300 may include the portion of the rotor blade 202 that, in operation, compresses air inside of the turbine engine 100. In one embodiment, the airfoil portion 300 may begin at the top surface of the base portion 302 and extend to the opposite end of the rotor blade 202. The surface of the base portion 302 may be flush with the surface of hub 204 (FIG. 2) when the rotor blade 202 is mounted in the slot 216.

The root portion 304 may represent the portion of the rotor blade 202 including the dovetail lobe 214 that slides axially into the hub 204 (FIG. 2) to mount the rotor blade 202 to the hub 204. As shown, the root portion 304 may begin at the bottom side of base portion 302, and, when the dovetail lobe 214 is mounted in the slot 216, may extend into the body of hub 204. In one embodiment, the airfoil portion 300, the base portion 302, and the root portion 304 may be integrally joined to one another as one piece of material.

During operation of the turbine engine 100, the rotation of hub 204 causes rotor blade 202 to generate an outward centrifugal force C along its length, in a direction perpendicular to the surface of the hub 204, i.e., radially outwardly from the hub 204. The centrifugal force C is met by a corresponding inward centrifugal force generated by a surface of the slot 216 (FIG. 2), which retains the rotor blade 202 in the hub 204. This retaining force stresses the rotor blade 202. Over time, the stress can cause fretting and/or cracks to form on or near a surface of the root portion 304 that contacts the inner surface of the slot 216, requiring the rotor blade 202 (and perhaps all of the remaining rotor blades 202 on the hub 204) to be replaced.

In order to address the fretting/cracking issue, the root portion 304 of the rotor blade 202 may have a groove 306 therein that redirects the stress away from the surface of the base portion 302 and deeper into the body thereof. In one embodiment, the groove 306 may be utilized in rotor blades 202 of the first compressor stage of the turbine engine 100. It is to be appreciated, however, that the groove 306 may be utilized in any number and/or combinations of rotor blades 202 and/or compressor stages of the turbine engine 100, depending upon the desired implementation.

Figure 4:
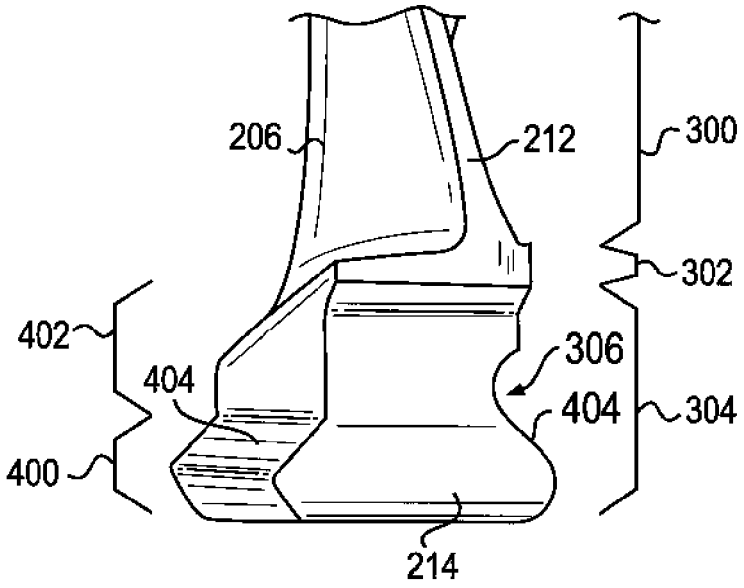
Figure 5:
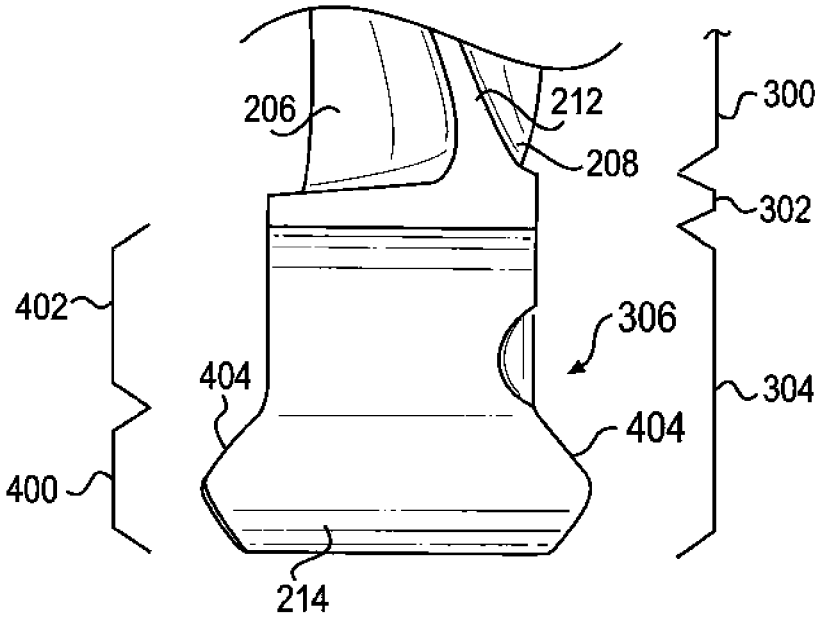

FIGS. 4 and 5 illustrate representations of the root portion 304 in greater detail, as viewed from the side of the trailing edge 212 of the rotor blade 202. As shown in these figures, the root portion 304 may include a dovetail portion 400 and a neck portion 402 located above the dovetail portion 400. It is noted that the neck portion 402 may be integrally joined to the dovetail portion 400 as one piece of material.

The dovetail portion 400 may include the dovetail lobe 214 of the rotor blade 202. As illustrated in FIGS. 4 and 5, the dovetail lobe 214 may have contact faces 404 that engage corresponding opposing contact faces of the slot 216 to retain the rotor blade 202 in the hub 204 against the outward centrifugal force C. In an axial-mounted dovetail embodiment, such as the one illustrated, one contact face 404 may be located on the same side as the suction sidewall 206 of the rotor blade 202, and another contact face 404 may be located on the opposite side, that is, the same side as the pressure sidewall 208 of the rotor blade 202.

The neck portion 402 may be located between the dovetail portion 400 and the base portion 302 of the rotor blade 202. In one embodiment, shown in the figures, the neck portion 402 does not include any contact faces for retaining the rotor blade 202 in the slot 216 against the outward centrifugal force C generated by the rotation of the hub 204. Rather, as discussed, the opposing forces provided by contact faces 404 in the dovetail portion 400 retain the rotor blade 202 in the slot 216.

Groove 306 may be positioned within the neck portion 402 of the root portion 304 of the rotor blade 202. In one embodiment, shown in the figures, the entirety of the groove 306 may be located within the neck portion 402, such that the groove 306 does not oppose a corresponding inner contact face of the slot 216 when the rotor blade 202 is mounted in the hub 204.

In one embodiment, as shown in the figures, the groove 306 may be located on the pressure-sidewall-side of the rotor blade 202. But, in other configurations, a groove 306 may be provided on the suction-sidewall-side of the rotor blade 202, or on both the pressure-sidewall-side and the suction-sidewall-side of the rotor blade 202.

Figure 6:
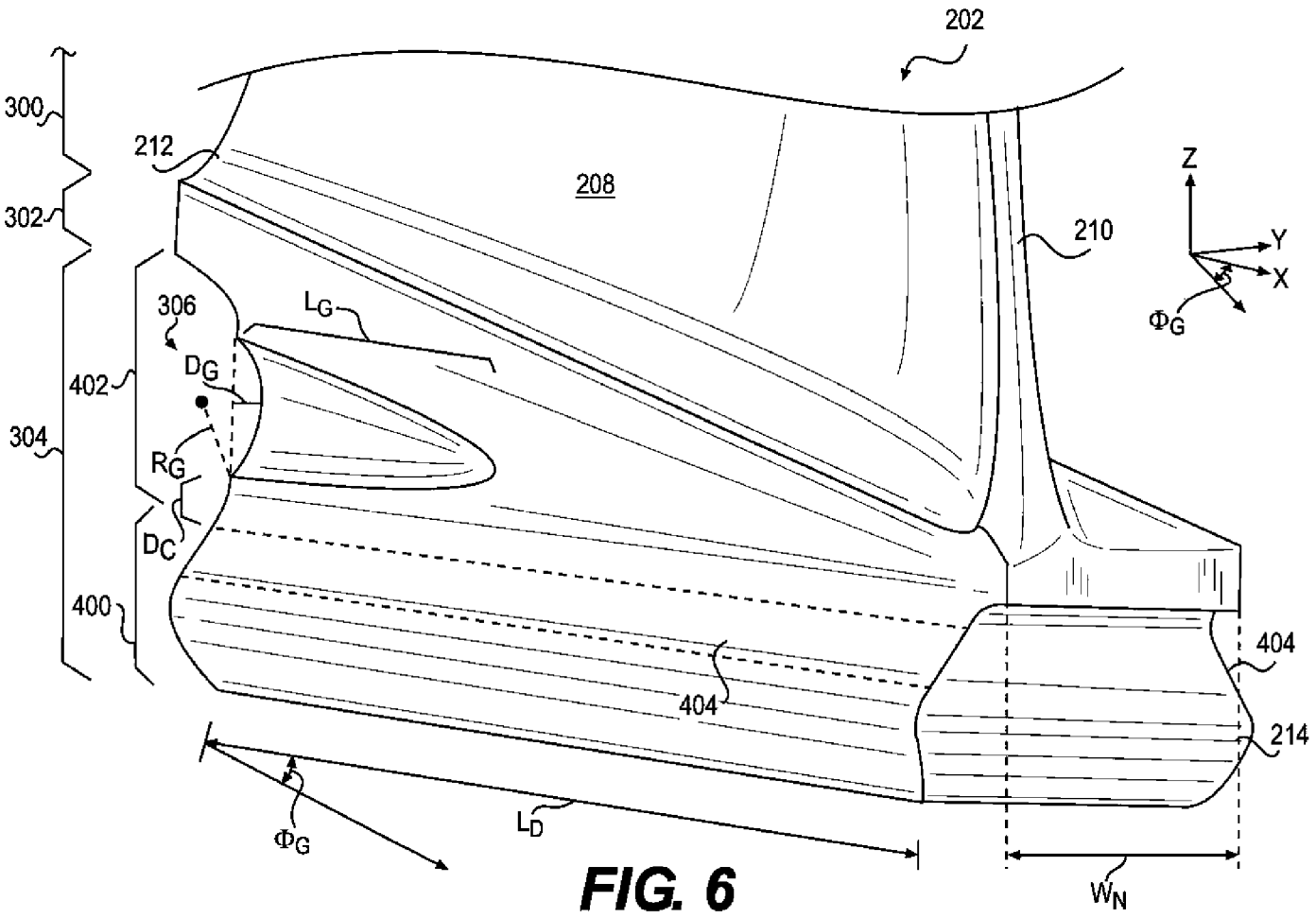

FIG. 6 illustrates a view of the rotor blade 202 from the side of the pressure sidewall 208 of the rotor blade 202. In the coordinate frame shown in the figure, the z-axis points in the direction from the dovetail lobe 214 toward the tip of the rotor blade 202, i.e., in the direction of the length of the rotor blade 202; the x-axis points in the direction from the trailing-edge-side of the dovetail lobe 214 toward the leading-edge-side of the dovetail lobe 214, i.e., along the length $L_D$ of the dovetail lobe 214; and the y-axis points in the direction from the pressure-sidewall-side of the dovetail lobe 214 toward the suction-sidewall-side of the dovetail lobe 214, i.e., along the width $W_D$ of the dovetail lobe 214.

Consistent with the disclosed embodiments, the groove 306 may begin at the trailing-edge-side of the dovetail lobe 214 and may extend toward the leading-edge-side thereof, along the length $L_D$ of the dovetail lobe 214. For example, the groove 306 may be a "corner-cut" groove located at the trailing-edge-side of the dovetail lobe 214. In one embodiment, a length $L_G$ of the groove 306 may be less than the length $L_D$ of the dovetail lobe 214. That is, the groove 306 may extend for only a portion of the length $L_D$ of the dovetail lobe 214. It is to be appreciated that the length $L_D$ of the dovetail lobe 214 and/or the length $L_G$ of the groove 306 may vary with the particular implementation of the turbine engine 100. As an example, if the length $L_D$ of the dovetail lobe 214 is 2.5 inches (6.35 cm), the length $L_G$ of the groove 306 may be about 0.75 inches (1.90 cm) (e.g., less than about ⅓ the length $L_D$ of the dovetail lobe 214). In this embodiment, a typical width $W_N$ of the neck 402 may be about 0.455 inches (1.2 cm).

Continuing with FIG. 6, in one embodiment, the groove 306 may have a constant radius of curvature $R_G$. The radius of curvature $R_G$ of the groove 306 may depend upon a variety of factors, such as the size of the rotor blade 202, the operational characteristics of the turbine engine 100, and/or other details relating to the implementation of the turbine engine 100. As an example, the groove 306 may have a constant radius of curvature $R_G$ of 0.095 inches (2.41 mm).

In one embodiment, shown in FIG. 6, the groove 306 may also have an initial, non-zero depth $D_G$ at the trailing-edge-side of the neck portion 402, i.e., at y=0 on the y-axis. The initial, non-zero depth $D_G$ is measured along the y-axis from the surface of the surrounding neck portion 402 to the bottom of the groove 306.

Additionally, as shown in FIG. 6, the groove 306 may gradually taper from its initial non-zero depth $D_G$ to a depth of zero, i.e., the surface of the neck portion 402. For example, the groove 306 may be defined by the surface of a cylinder intersecting the neck portion 402 at the initial non-zero depth $D_G$ and having its lengthwise axis set at a non-zero angle $\Phi_G$ relative to the x-axis, i.e., the length $L_D$ of the dovetail lobe 214. It is to be appreciated that the angle $\Phi_G$ of the groove 306 may depend upon the particular implementation of the turbine engine 100. Continuing with the example above where the length $L_D$ of the dovetail lobe 214 is about 2.5 inches (6.35 cm) and the length $L_G$ of the groove 306 is about 0.75 inches (1.90 cm), the groove angle $\Phi_G$ may be about 4.2 degrees.

It is noted that the radius of curvature $R_G$ of the groove 306 may be the same as or different from the initial depth $D_G$ of the groove 306. As with other dimensions, the values for the radius of curvature $R_G$ of the groove 306 and the initial depth $D_G$ of the groove 306 may depend upon the particular implementation of the turbine engine 100. Continuing with the example above where the radius of curvature $R_G$ of is about 0.095 inches (2.41 mm), an appropriate value for the initial depth $D_G$ of the groove 306 may be about 0.055 inches (1.40 mm) (i.e., less than the radius of curvature $R_G$). It is noted that the initial depth $D_G$ of the groove 306 and the angle $\Phi_G$ of the groove 306 may determine the length $L_G$ of the groove 306, i.e., the distance along the x-axis at which the groove 306 has no depth. In this example, an initial groove depth $D_G$ of 0.055 inches (1.40 min) and a groove angle $\Phi_G$ of 4.2 degrees provides a groove length $L_G$ of about 0.75 inches (1.90 cm).

FIG. 6 shows that the groove 306 may be positioned in the neck portion 402, above the contact face 404 of the dovetail lobe 214. In FIG. 6, the boundaries of the contact face 404 are delineated by the hashed lines. For example, in some embodiments, the lower edge of the groove 306 may be located a non-zero distance $D_C$ from the contact face 404, measured on the z-axis. Accordingly, in the embodiment shown, the entirety of the groove 306 is outside (i.e., above) the contact face 404 of the dovetail lobe 214 due to the distance $D_C$ between the contact face 404 and the groove 306. It is noted that the distance $D_C$ of the groove 306 from the contact face 404 may depend upon the particular implementation of the turbine engine 100. As an example consistent with the discussion above, the groove 306 may be positioned a distance $D_C$ of 0.0093 inches (0.024 cm) from the contact face 404 (along the z-axis). In other embodiments, however, there may be no distance between the groove 306 and the contact face 404, that is, the groove 306 may begin where the contact face 404 ends.

INDUSTRIAL APPLICABILITY

The disclosed rotor blade groove 306 may have applicability in any turbine engine known in the art. In addition, the disclosed groove 306 may provide several benefits and advantages over the prior art. As discussed, the disclosed groove 306 may redirect the stress caused by the centrifugal force of the rotor blade 202 away from the surface of the root portion 304 and deeper into the body of the part. This redirection of stress may reduce the cracking and/or fretting that tends to occur at the surface of the root portion 304 (and, in particular, near the boundary between the neck portion 402 and the dovetail portion 400). Accordingly, the disclosed groove 306 may extend the useful life of the rotor blade 202.

Additional advantages may be realized by the configuration of the disclosed groove 306. For example, as can be appreciated from the above description and the drawings, the disclosed groove 306 may have a non-intrusive design compared, for example, to deep undercuts on both sides of the rotor blade that extend the entire length or width of the dovetail. Accordingly, the disclosed embodiments in which the length $L_D$ of the groove 306 is less than the length $L_D$ of the dovetail lobe 214; in which the groove 306 begins at the trailing-edge side of the neck portion 402 of the rotor blade 202 and extends toward the leading-edge-side of the neck portion 402, but ends after a portion (e.g., less than about ⅓) of the length $L_D$ of the dovetail lobe 214 (e.g., a "corner-cut" groove); in which the groove 306 has an initial non-zero depth $D_G$ at the trailing-edge side of the neck portion 402 and gradually tapers in the direction of the leading-edge-side of the neck portion 402 to zero depth before reaching the leading-edge-side of the dovetail lobe 214; in which the groove 306 is defined by the surface of a cylinder having a radius (i.e., the radius of curvature $R_G$ of the groove 306), intersecting the neck portion 402 at an initial non-zero depth $D_G$, and having its lengthwise axis set at a non-zero angle $\Phi_G$ relative to the direction of the length $L_D$ of the dovetail lobe 214; in which the length of the groove 306 is less than the length of the dovetail 214; and/or in which the groove 306 is relatively shallow, may require little encroachment into the rotor blade 202 to provide for the groove 306.

Thus, the presence of the disclosed groove 306 may have a reduced impact on the performance of the rotor blade 202 when compared with prior art solutions. For example, the presence of the groove 306 may only negligibly reduce the load-bearing capacity of the rotor blade 202. Additionally, the design may only negligibly change the vibration frequency response of the rotor blade 202. Additionally, it may only negligibly increase the average stress across the neck portion 402 of the rotor blade 202 but reduce the maximum overall stress in the area of the dovetail 214, instead of introduce a maximum stress concentration along the groove 306. Accordingly, incorporating the groove 306 on the rotor blade 202 may not introduce undesired and/or unaccounted for effects into a given design.

Additionally, providing a groove 306 in the neck portion 402, as opposed to an undercut in the contact face 404, allows a larger surface area for the contact face 404. The larger surface area can reduce the pressure and/or friction and, thus, wear on the contact face 404 over the life of the rotor blade 202.

It will be apparent to those skilled in the art that various modifications and variations can be made to the embodiments without departing from the spirit and scope of the disclosure. Other embodiments will be apparent to those skilled in the art from consideration of the specification and practice of the disclosure. It is intended that the specification and examples be considered as exemplary only, with a true scope of the disclosure being indicated by the following claims and their equivalents.

What is claimed is:

1. A rotor blade for a gas turbine engine, comprising:
an airfoil;
a base integrally joined to the airfoil; and
a root integrally joined to the base and mountable in a slot in a rotor hub of the gas turbine engine, the root comprising;
a dovetail including at least one contact face that, when the root is mounted in the slot, contacts a surface of the slot to retain the rotor blade in the hub;
a neck between the base and the dovetail; and
a groove formed in the neck for redirecting stress in the rotor blade, wherein the groove is at a distance from the at least one contact face;
wherein the length of the groove is less than ⅓ the length of the dovetail;
wherein the airfoil includes a trailing edge and a leading edge;
wherein the groove begins at the same side of the rotor blade as the trailing edge and extends toward the same side of the rotor blade as the leading edge; and
wherein the groove has an initial non-zero depth at the side of the trailing edge and gradually tapers along the entire groove length to a depth of zero in the direction of the leading edge.

2. The rotor blade of claim 1, wherein the groove is defined by a surface of a cylinder intersecting the neck at the initial non-zero depth and having its lengthwise axis at a non-zero angle relative to a direction of a length of the dovetail.

3. The rotor blade of claim 2, wherein a radius of the cylinder is greater than the initial non-zero depth.

4. The rotor blade of claim 1, wherein the groove has a constant radius of curvature.

5. The rotor blade of claim 1, wherein the groove is linear with a lengthwise axis set at a non-zero angle relative to a direction of a length of the dovetail.

6. The rotor blade of claim 1, wherein the groove is on the same side of the rotor blade as a pressure sidewall of the airfoil.

7. The rotor blade of claim 1, wherein the groove is on the same side of the rotor blade as a trailing edge of the airfoil.

8. The rotor blade of claim 1, wherein the root is configured to be axially-mounted into the slot.

9. A rotor blade for a gas turbine engine, comprising:
an airfoil including a leading edge and a trailing edge;
a base integrally joined to the airfoil; and
a root integrally joined to the base and mountable in a slot in a rotor hub of the gas turbine engine, the root comprising:
a dovetail including at least one contact face that, when the root is mounted in the slot, contacts a surface of the slot to retain the rotor blade;
a neck between the base and the dovetail; and
a groove formed in the neck for redirecting stress in the rotor blade, wherein the groove begins at the same side of the rotor blade as the trailing edge and extends toward the same side of the rotor blade as the leading edge, and has an initial non-zero depth at the side of the trailing edge and tapers along an entire groove length to a depth of zero in the direction of the leading edge, and the groove is at a distance from the at least one contact face;
wherein the length of the groove is less than ⅓ the length of the dovetail;
wherein the groove is defined by a surface of a cylinder intersecting the neck at the initial non-zero depth and having its lengthwise axis at a non-zero angle relative to a direction of a length of the dovetail;
wherein a radius of the cylinder is greater than the initial non-zero depth; and
wherein the groove has a constant radius of curvature.

10. A rotor blade for a gas turbine engine, comprising:
an airfoil including a leading edge and a trailing edge;
a base integrally joined to the airfoil; and
a root integrally joined to the base and mountable in a slot in a rotor hub of the gas turbine engine, the root comprising:
a dovetail including at least one contact face that, when the root is mounted in the slot, contacts a surface of the slot to retain the rotor blade;
a neck between the base and the dovetail; and
a groove formed in the neck for redirecting stress in the rotor blade, wherein the groove begins at the same side of the rotor blade as the trailing edge and extends toward the same side of the rotor blade as the leading edge, and has an initial non-zero depth at the side of the trailing edge and tapers along an entire groove length to a depth of zero in the direction of the leading edge, and the groove is at a distance from the at least one contact face;
wherein the length of the groove is less than ⅓ the length of the dovetail;
wherein the groove is defined by a surface of a cylinder intersecting the neck at the initial non-zero depth and having its lengthwise axis at a non-zero angle relative to a direction of a length of the dovetail; and
wherein a radius of the cylinder is greater than the initial non-zero depth; and
wherein the groove is linear with a lengthwise axis set at a non-zero angle relative to a direction of a length of the dovetail.

* * * * *